United States Patent [19]

Leong et al.

[11] Patent Number: 4,493,523

[45] Date of Patent: Jan. 15, 1985

[54] ADAPTIVE STRAIN RELIEF FOR WIRING DEVICES

[75] Inventors: Henry Leong, Kendall Park; John Fiumefreddo, Colonia, both of N.J.

[73] Assignee: Challenger Circle F, Inc., Trenton, N.J.

[21] Appl. No.: 541,801

[22] Filed: Oct. 18, 1983

[51] Int. Cl.[3] ..... H01R 13/58

[52] U.S. Cl. ..... 339/105; 339/63 R; 339/103 R

[58] Field of Search ..... 339/63 R, 63 M, 103 R, 339/103 M, 103 B, 105, 107, 196 R, 196 A, 196 M; 174/153 G

[56] References Cited

U.S. PATENT DOCUMENTS

| | | | |
|---|---|---|---|
| 2,590,886 | 4/1952 | Pedersen | 339/107 |
| 2,673,968 | 3/1954 | Smith | 339/99 |
| 3,409,858 | 11/1968 | Krehbiel | 339/91 |
| 3,784,961 | 1/1974 | Gartland, Jr. | 339/107 |
| 3,816,819 | 6/1974 | Judd | 339/99 |
| 4,010,999 | 3/1977 | Hoffman | 339/107 |
| 4,072,391 | 2/1978 | Hung | 339/196 R |
| 4,117,998 | 10/1978 | Notoya | 339/105 |
| 4,138,185 | 2/1979 | Jaconette, Jr. | 339/107 |
| 4,155,617 | 5/1979 | Hung | 339/196 R |

*Primary Examiner*—Neil Abrams

*Attorney, Agent, or Firm*—Sperry, Zoda & Kane

[57] ABSTRACT

A wiring device has an entry hole through which an electric cord may be passed. The device has a serrated corner positioned opposite the entry hole and a flexible finger near the entry hole. An electric cord inserted in the entry hole is locked between the finger and the serrated corner.

1 Claim, 4 Drawing Figures

ADAPTIVE STRAIN RELIEF FOR WIRING DEVICES

BACKGROUND OF THE INVENTION

This invention pertains to wiring devices and, more particularly, is concerned with wiring devices such as plugs and receptacles for terminating electrical cords.

Numerous designs for plugs and receptacles for terminating cords have been disclosed over the years. The so-called stripless type are now in favor for use by the domestic consumer as no tools are required other than a pair of scissors to trim the cord.

For years the common cord for lamps and the like was made to meet Underwriter's Laboratories Standard SPT-1. There is now a change over to U.L. Standard SPT-2 cord which has substantially thicker insulation. It is likely that both size cords will coexist in the home for some time. For this reason it is desirable to provide a quick connect wire device which will accept both size cords and which, at the same time, provides safety features to protect the user.

For a better understanding of the present invention, together with advantages and capabilities thereof, reference is made to the following disclosure and appended claims in connection with the above-described drawings.

DESCRIPTION OF THE INVENTION

Figure 1:
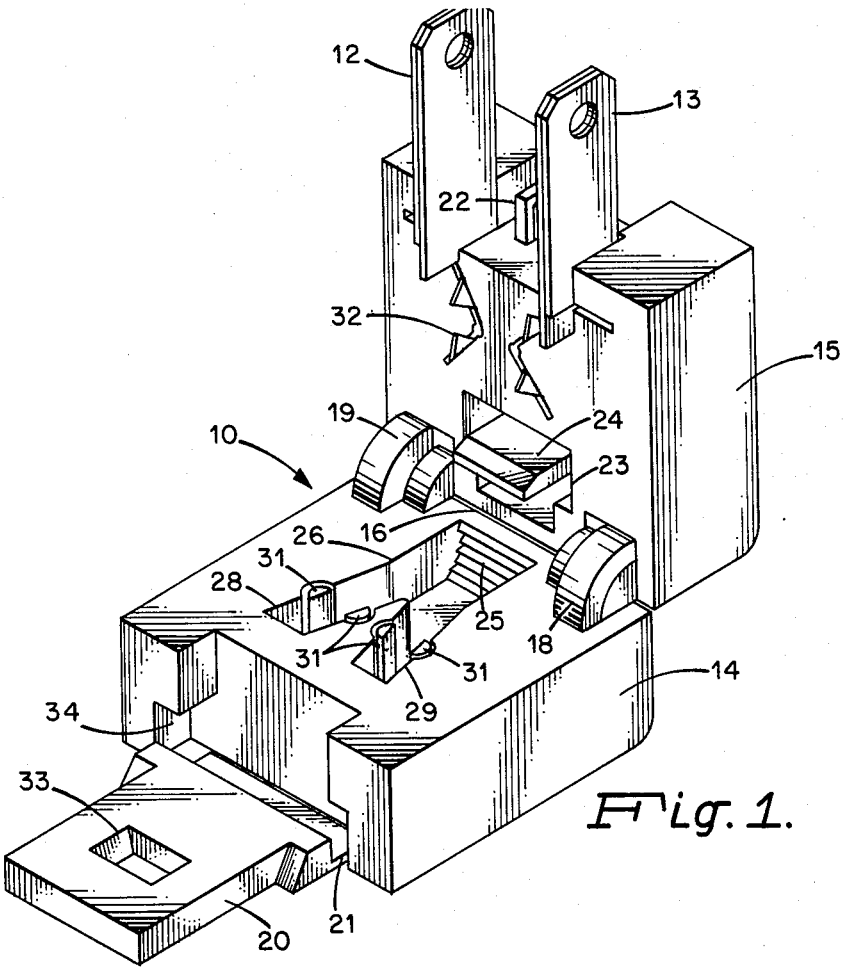
FIG. 1 shows in an open position a wiring device embodying the invention.

FIG. 1 shows a wiring device 10 which embodies the invention. The device shown is a male plug for terminating one end of a cord set; however, with minor design changes the device could be manufactured as a female receptacle.

The device has only three pieces which are a body 11 and two electrical contacts 12, 13. The contacts 12, 13 may be blades if the device is a plug and female contacts if the device is a receptacle.

Body 11 is molded in one piece of a flexible plastic such as polypropylene. The body has a first segment 14 and a second segment 15 joined by a web 16 of thin plastic, known as a living hinge. In FIG. 1 the device 10 is shown in an open position prior to receiving an electric cord.

Figure 2:
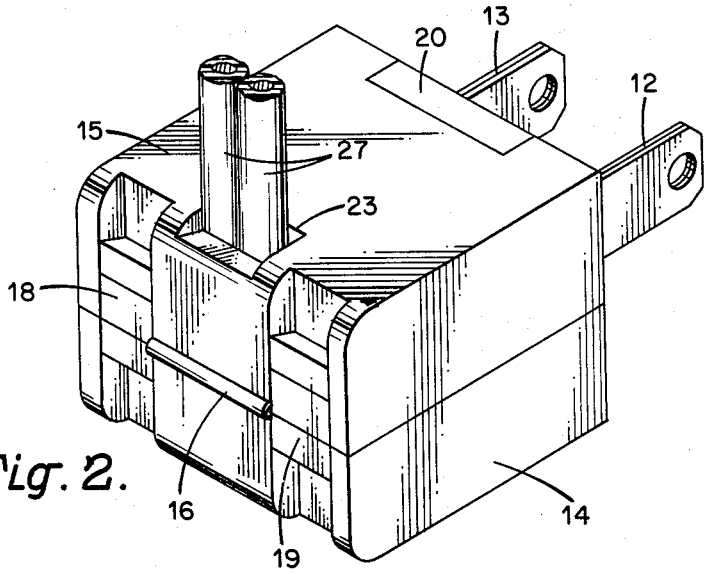
FIG. 2 shows the device of FIG. 1 in a closed position.

As seen in FIG. 2, a first living hinge 16 allows the two segments to pivot together as a book would close. Mating members of mechanical hinge 18, 19 are provided on each end of the first living hinge 16 so that if the first living hinge fails the two segments 14, 15 will remain latched together when in a closed position.

The segments 14, 15 may be latched in a closed position by a latch piece 20 which is attached to a second living hinge 21 on the first segment 14. Prongs 22 on second segment 15 engage a hole 33 in latch piece 20 when the device is closed. The end of latch piece 20 nearest hinge 21 is wider than the end nearest hole 33. The first segment 14 has a corresponding recess 34 to accept the latch piece 20. When the segments are closed the latch piece 20 forms an interlocking joint with the first segment 14 so that even if the second living hinge 21 fails the segments will remain latched in a closed position. Both latch piece 20 and recess 34 may be T-shaped.

Returning to FIG. 1, the second segment 15 has a rectangular entry hole 23 for accepting the end of an electric cord and a flexible finger 24 located adjacent to the entry hole 23.

Figure 3:
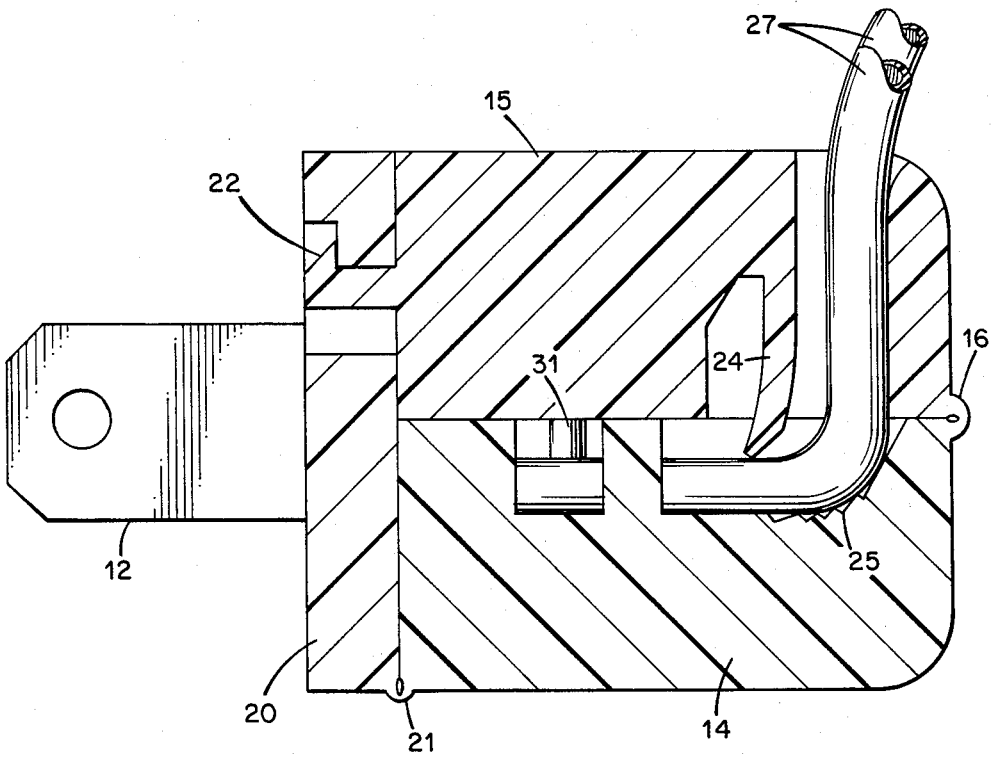
FIG. 3 illustrates in more detail the strain relief feature of the wiring device.

The first segment 14 is recessed to accept the cord. In the embodiment shown first segment 14 has a serrated corner 25 which leads the cord into a Y-shaped channel 26. As seen in FIG. 3, when the segments 14, 15 are closed the serrated corner is opposite the entry hole 23. When a cord 27 is inserted through the entry hole 23 and the segments 14, 15 are closed, the cord 27 bends around the corner into the channel 26. The tip of the flexible finger 24 is in contact with the cord 27, and if the cord is pulled, the flexible finger 24 urges the cord 27 against the serrated corner 25 locking the cord in place and providing strain relief.

Turning again to FIG. 1, channel 26 branches in two narrower channels 28, 29 which are separated by a divider 30. The cord is to be split into two wires which are laid in the separate channels 28, 29. This arrangement prevents short circuits which might otherwise occur if there are frayed wire strands.

Figure 4:
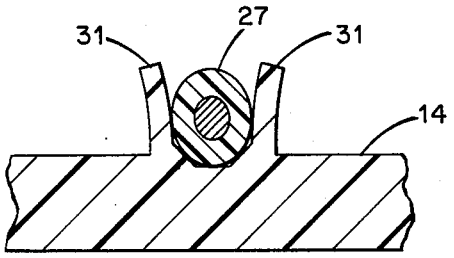
FIG. 4 shows in more detail the channel and post arrangement of the wiring device.

As best shown in FIG. 4, the bottom of the channels are beveled so that the wires self-center within their corresponding channel.

At least one pair of flexible posts 31 are provided for each narrow channel. The posts 31 of each pair are arranged on opposite sides of the narrow channel to grip the wire and hold it in the corresponding narrow channel during assembly.

Due to the adaptable strain relief and the self-centering channels with flexible posts, the device will accept different size braidless parallel cord such as that which meets U.L. specification SPT-1 and SPT-2. Both types call for 18 gauge wire. SPT-1 uses 30 mil thick insulation and separates the wires by 3/64 inch, whereas SPT-2 uses 45 mil thick insulation and separates the wires by 5/64 inch.

Electrical contacts 12, 13 are made of copper or other metal and are carried by the second segment 15. The contacts have points 32 arranged to pierce the insulation of the wire when the segments are closed. Each contact may have two or more points which are slightly offset so as to straddle the center of the wire preventing the wire from turning. The contacts may be blades or they may be female contacts with corresponding changes to the body.

The described wiring device accepts both SPT-1 and SPT-2 standard wire. Only three pieces are used in its construction and is unitary so far as the consumer is concerned.

While there has been shown and described what is at present considered the preferred embodiment of the invention, it will be obvious to those skilled in the art that various changes and modifications may be made therein without departing from the scope of the invention as defined by the appended claims.

We claim:

1. A wiring device for terminating electrical cords comprised of:

a first segment;

a second segment pivotally arranged with said first segment and having an entry hole for receiving an end of an electric cord;

a serrated corner arranged on said first segment to be opposite said entry hole when said segments are in a closed position;

a flexible finger arranged on said second segment in proximity to said entry hole so that an electric cord inserted in said entry hole is locked between said finger and said serrated corner when said segments are in a closed position, thereby providing strain relief.

* * * * *